US007261518B2

(12) United States Patent
Golinkin et al.

(10) Patent No.: US 7,261,518 B2
(45) Date of Patent: Aug. 28, 2007

(54) LOCKING ARRANGEMENT FOR RADIAL ENTRY TURBINE BLADES

(75) Inventors: Samuel Golinkin, East Windsor, NJ (US); Michael J. Lipski, Trenton, NJ (US); John S. Loudon, Mt. Laurel, NJ (US); Gennaro J. DiOrio, Trenton, NJ (US); Timothy Ewer, East Windsor, NJ (US)

(73) Assignee: Siemens Demag Delaval Turbomachinery, Inc., Trenton, NJ (US)

( * ) Notice: Subject to any disclaimer, the term of this patent is extended or adjusted under 35 U.S.C. 154(b) by 225 days.

(21) Appl. No.: 11/088,639

(22) Filed: Mar. 24, 2005

(65) Prior Publication Data

US 2006/0216152 A1 Sep. 28, 2006

(51) Int. Cl.
*B63H 1/20* (2006.01)

(52) U.S. Cl. ..... 416/215; 416/220 R; 416/222; 416/241 R

(58) Field of Classification Search ..... 416/215, 416/220 R, 222, 241 R
See application file for complete search history.

(56) References Cited

U.S. PATENT DOCUMENTS

| | | | | |
|---|---|---|---|---|
| 1,362,074 | A | | 12/1920 | Baumann |
| 2,199,243 | A | | 4/1940 | Mortimer |
| 2,220,918 | A | | 11/1940 | Smith |
| 2,916,257 | A | | 12/1959 | Poelimitz et al. |
| 3,501,249 | A | | 3/1970 | Scalzo et al. |
| 3,986,793 | A | | 10/1976 | Warner et al. |
| 4,094,615 | A | | 6/1978 | Glenn |
| 4,191,509 | A | | 3/1980 | Leonardi |
| 4,702,673 | A | | 10/1987 | Hansen et al. |
| 4,730,984 | A | * | 3/1988 | Ortolano ..... 416/222 |
| 4,767,274 | A | | 8/1988 | Walter |
| 4,784,573 | A | | 11/1988 | Ress, Jr. |
| 4,790,723 | A | | 12/1988 | Wilson et al. |
| 4,813,850 | A | | 3/1989 | Partington |
| 4,824,328 | A | | 4/1989 | Pisz et al. |
| 4,904,160 | A | | 2/1990 | Partington |
| 4,915,587 | A | | 4/1990 | Pisz et al. |
| 5,001,830 | A | | 3/1991 | Partington et al. |
| 5,022,822 | A | | 6/1991 | Sincere |
| 5,110,262 | A | | 5/1992 | Evans |
| 5,131,814 | A | | 7/1992 | Przytulski et al. |
| 5,141,401 | A | | 8/1992 | Juenger et al. |
| 5,152,669 | A | | 10/1992 | Heinig et al. |
| 5,176,500 | A | | 1/1993 | Heinig |
| 5,340,280 | A | | 8/1994 | Schilling |
| 5,405,245 | A | | 4/1995 | Cornelius |
| 5,425,622 | A | | 6/1995 | Murray |
| 5,430,936 | A | | 7/1995 | Yazdzik, Jr. et al. |

(Continued)

*Primary Examiner*—Igor Kershteyn

(57) ABSTRACT

A locking arrangement for a row of radial entry blades (62) of a turbo-machine. A closing blade (66) includes a root portion (74) having an axial attachment shape (78) for engagement with an axially oriented slot having an axial attachment shape (76) formed at the entering slot location (34) of the radial entry rotor disk (56). For applications utilizing blades with curved platform faces (112), a preceding blade (108) and a following blade (110) in the row are designed with one curved face for abutting adjacent radial entry blades and one flat face (120) for abutting the flat closing blade faces (116). The closing blade (84) may be designed with a root portion (88) having two legs (90,92) that are urged apart by a key (86) into tight contact with the adjacent blades.

45 Claims, 6 Drawing Sheets

U.S. PATENT DOCUMENTS

| | | | | |
|---|---|---|---|---|
| 5,501,575 | A | 3/1996 | Eldredge et al. | |
| 5,509,784 | A | 4/1996 | Caruso et al. | |
| 5,741,119 | A | 4/1998 | Heppenstall | |
| 5,836,742 | A | 11/1998 | Dierksmeier et al. | |
| 5,863,183 | A | 1/1999 | Dierksmeier et al. | |
| 6,019,580 | A | 2/2000 | Barr et al. | |
| 6,302,651 | B1 | 10/2001 | Kildea et al. | |
| 6,499,959 | B1 * | 12/2002 | Reluzco et al. | 416/241 R |
| 6,755,618 | B2 * | 6/2004 | Munshi et al. | 416/220 R |
| 6,796,769 | B2 | 9/2004 | Moroso | |
| 2004/0067137 | A1 | 4/2004 | Moroso | |
| 2004/0115052 | A1 | 6/2004 | Murphy | |

* cited by examiner

LOCKING ARRANGEMENT FOR RADIAL ENTRY TURBINE BLADES

FIELD OF THE INVENTION

This invention relates generally to the field of turbo-machines, and more particularly to the field of turbine blade attachments.

BACKGROUND OF THE INVENTION

In a turbo-machine, such as a gas or steam turbine, rows of blades project radially outwardly from the circumferences of respective rotor disks that are, in turn, attached along a length of an axially aligned shaft. Each blade extends radially from a rotor disk and is affixed at its root to the disk by a mechanical connection. An airfoil portion of each blade reacts to the forces of a working fluid flowing axially through the machine to produce rotation of the rotor, thereby extracting mechanical shaft power from the working fluid. The blades experience steady state centrifugal forces, bending moments and alternating forces during operation. In addition, blade vibration from alternating forces will generate significant stresses on the attachment structure.

Blades are attached to the rotor disk with one of two styles of mechanical connections: an axial attachment or a radial attachment. FIG. 1 is a perspective view of one embodiment of an axial (side entry) blade attachment mechanism for a turbo-machine. A turbine rotor disk 2 is formed to have a plurality of equally spaced axially oriented grooves 4 disposed around its circumference. Each groove 4 is individually milled or broached to a predetermined shape, such as the fir tree design of FIG. 1. Blades 6*a*, 6*b*, 6*c* are disposed about the circumference of the rotor disk 2, each blade 6 having a root portion 8 formed for sliding side entry into a respective groove 4 of the disk 2. The platform portions 10 of adjacent blades define one side of a flow path for the working fluid as it passes through the airfoil portions 12 of the blades. In most embodiment, shrouds (not illustrated) are disposed along the outer circumference of the airfoils to create a mechanical connection between the blades. There is generally no contact between platforms of adjacent blades 6*a*, 6*b*, and 6*c* . Examples of axial blade attachments may be found in U.S. Pat. Nos. 3,501,249 and 5,176,500, both incorporated by reference herein.

FIG. 2 is a perspective view of one embodiment of a prior art radial entry blade attachment mechanism for a turbo-machine. A rotor disk 14 has a single continuous groove 16 formed around its circumference. One will appreciate that the manufacturing cost for forming such a continuous groove 16 is significantly less than the manufacturing cost for forming the individual axial grooves 4 described in FIG. 1. The radial groove 16 of FIG. 2 has a female fir tree shape, although other shapes, including a male fir tree shape and a T-shank shape, are known. Each blade 18*a*, 18*b* has a mating male root portion 20 that is engaged within the rotor disk groove 16.

FIG. 3 is a perspective view of a second embodiment of a prior art radial entry blade attachment mechanism. A rotor disk 24 is formed to have a continuous T-shank shape 26 around its circumference in lieu of the groove 16 of FIG. 2. The root portions 28 of each of the blades 30*a*, 30*b* have a mating T-shank shaped groove 32 formed therein. The blades 30*a*, 30*b* are individually installed onto the rotor disk 24 at an entering slot location. The entering slot location is not illustrated in FIG. 3, however, an exemplary entering slot location 34 for a fir tree design radial entry rotor disk 25 is shown in FIG. 4. One entering slot location 34 or two diametrically opposed entering slot locations may be used. The lugs of the T-shank shape 26 (or fir tree shape 26 as appropriate) are missing at the entering slot location so as to allow the blades to be moved into position in a radial direction. The blades are then free to be slid circumferentially around the perimeter of the rotor disk 24 from the entering slot location to their final installed position as illustrated in FIG. 3. The blades 30*a*, 30*b* make contact with each other at the root portion 28 when a full complement of blades 30 is installed.

Once a full complement of blades is installed onto a radial entry disk, a closing blade 36, as illustrated in FIG. 5 for a fir tree design, must be installed into the entering slot location 34. One or more pins (not shown) are installed through respective mating holes 38, 40 formed in the rotor disk 25 at the entering slot location 34 and in the closing blade 36 to provide a radial attachment mechanism. The pins function to resist the centrifugal forces generated during operation of the machine, since the lugs of the fir tree shape are missing at the closing piece location 34. Examples of radial blade attachments may be found in U.S. Pat. Nos. 4,915,587 and 5,176,500, both incorporated by reference herein.

While radial entry blade attachment is often a more economical choice than axial blade attachment, it is known that the stresses imposed upon the pins of the closing blade attachment are higher than those experienced in the lugs of the adjoining blades. For some large blade configurations or high speed rotors, the stresses are so high that the closing blade 36 must be replaced with a closing piece 42, such as the one illustrated in FIG. 6. The closing piece 42 has the same root/platform portion 44 as the closing blade 36 but it lacks an airfoil portion and thus generates relatively little centrifugal force during operation of the turbine. In order to maintain the turbine rotor in balance when a closing piece 42 is installed in the entering slot location 34, a filling piece 46 as illustrated in FIG. 7 may be installed in lieu of a blade 30 at the location diametrically opposed to the entering slot location 34. While this approach solves the problem of high stress levels at the closing location, it results in a decrease in turbine efficiency due to the two missing airfoil portions in each row of blades. Furthermore, the perturbations of the working fluid flow created by the missing blades cause an increase in the alternating stress levels on the blades and blade attachments. This effect may be exacerbated because an outer shroud (not shown) connected to each blade at their respective radially outermost ends 48 can not span an entire 360° arc; but rather, because of the missing airfoil portions, may be formed into two sections each spanning somewhat less than a 180° arc. Accordingly, bending moments and the alternating stress levels in all of the blades are adversely affected by the absence of two airfoil portions within the row of blades.

U.S. Pat. No. 4,094,615, incorporated by reference herein, describes a blade attachment arrangement for the ceramic blades of a high temperature gas turbine engine. Ceramic material does not exhibit a high tensile strength, and a standard blade attachment arrangement is not acceptable for this application. Accordingly, each blade is attached to the rotor disk via an individual metallic attachment member. The turbine disk in this arrangement is fabricated to have a plurality of axial grooves along its circumference, as in the typical axial blade attachment arrangement described above. The metallic attachment members each have a root portion for engaging a mating groove of the rotor. The attachment members also each have an outer peripheral groove for receiving a root of a corresponding ceramic blade. Opposed slots are formed in the attachment members and the blade platforms for receiving metal plates that transfer torque from the blades to the corresponding attachment piece, thereby reducing stress levels in the ceramic blade roots. The attachment piece and the metal plates combine to support the blade during operation. In addition, a second series of opposed plates is required to protect the attachment from the high temperatures. This blade attachment arrangement is complicated and expensive and would not be desirable for a standard metallic turbine blade application.

BRIEF DESCRIPTION OF THE DRAWINGS

The invention is explained in following description in view of the drawings that show.

DETAILED DESCRIPTION OF THE INVENTION

Figure 1:
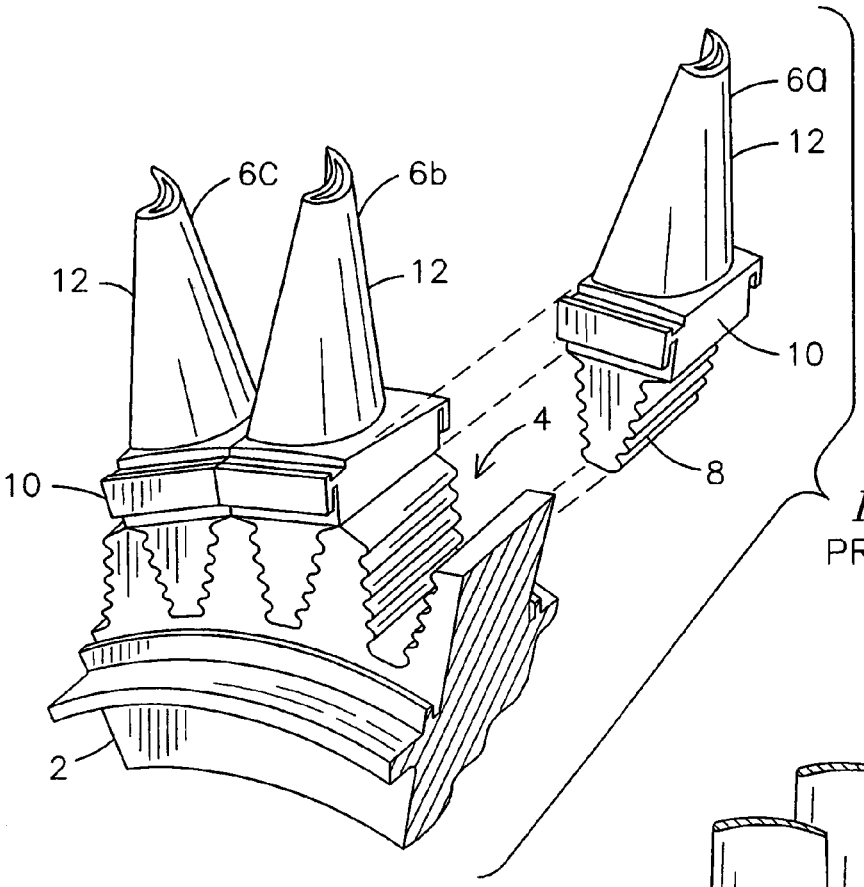
FIG. 1 PRIOR ART
FIG. 1 is a partial perspective view of a prior art turbine rotor disk having axial entry blades.
Figure 2:
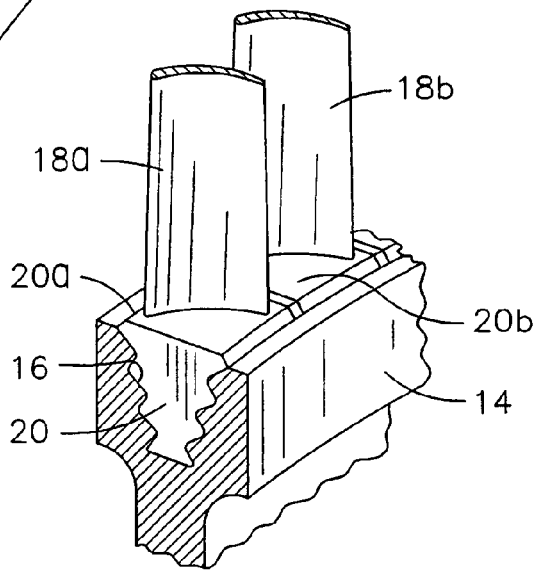
FIG. 2 PRIOR ART
FIG. 2 is a partial perspective view of a prior art turbine rotor disk having radial entry blades utilizing a circumferential groove in the rotor disk.
Figure 3:
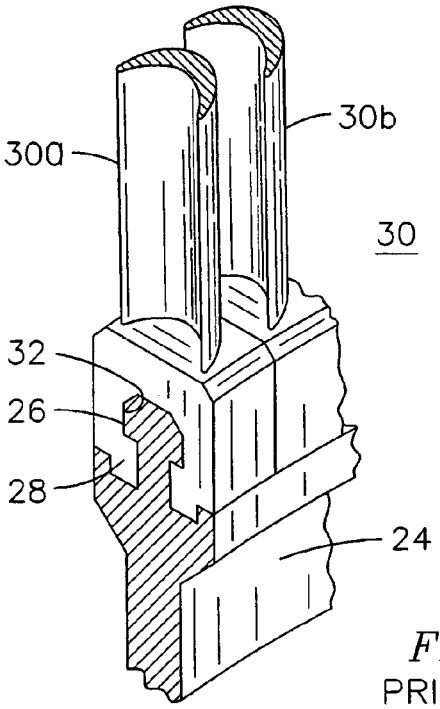
FIG. 3 PRIOR ART
FIG. 3 is a partial perspective view of a prior art turbine rotor disk having radial entry blades utilizing a T-shank shape in the rotor disk.
Figure 4:
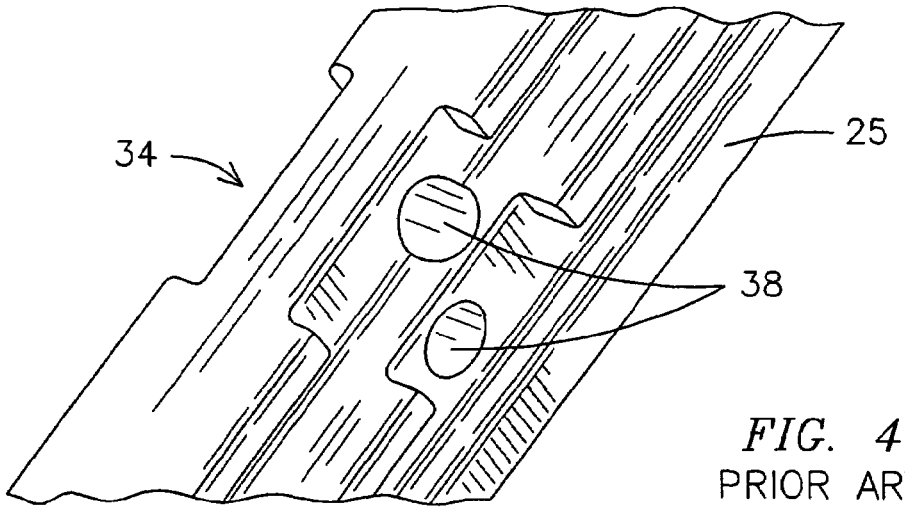
FIG. 4 PRIOR ART
FIG. 4 is a perspective view of an entering slot location of a prior art radial entry fir tree style turbine rotor disk.
Figure 5:
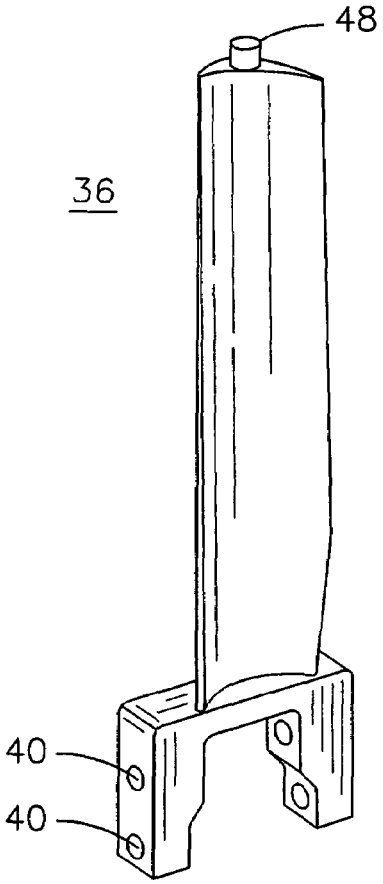
FIG. 5 PRIOR ART
FIG. 5 is a perspective view of a prior art closing blade.
Figure 6:
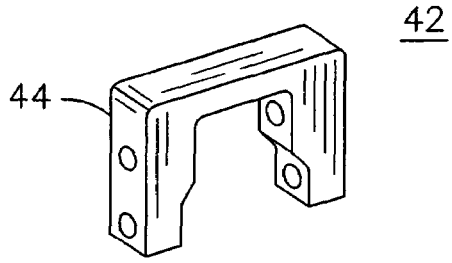
FIG. 6 PRIOR ART
FIG. 6 is a perspective view of a prior art closing piece.
Figure 7:
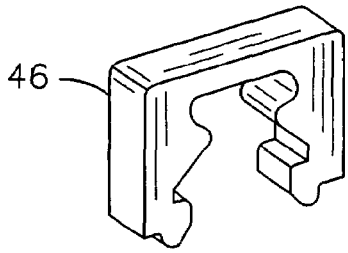
FIG. 7 PRIOR ART
FIG. 7 is a perspective view of a prior art filling piece.
Figure 8:
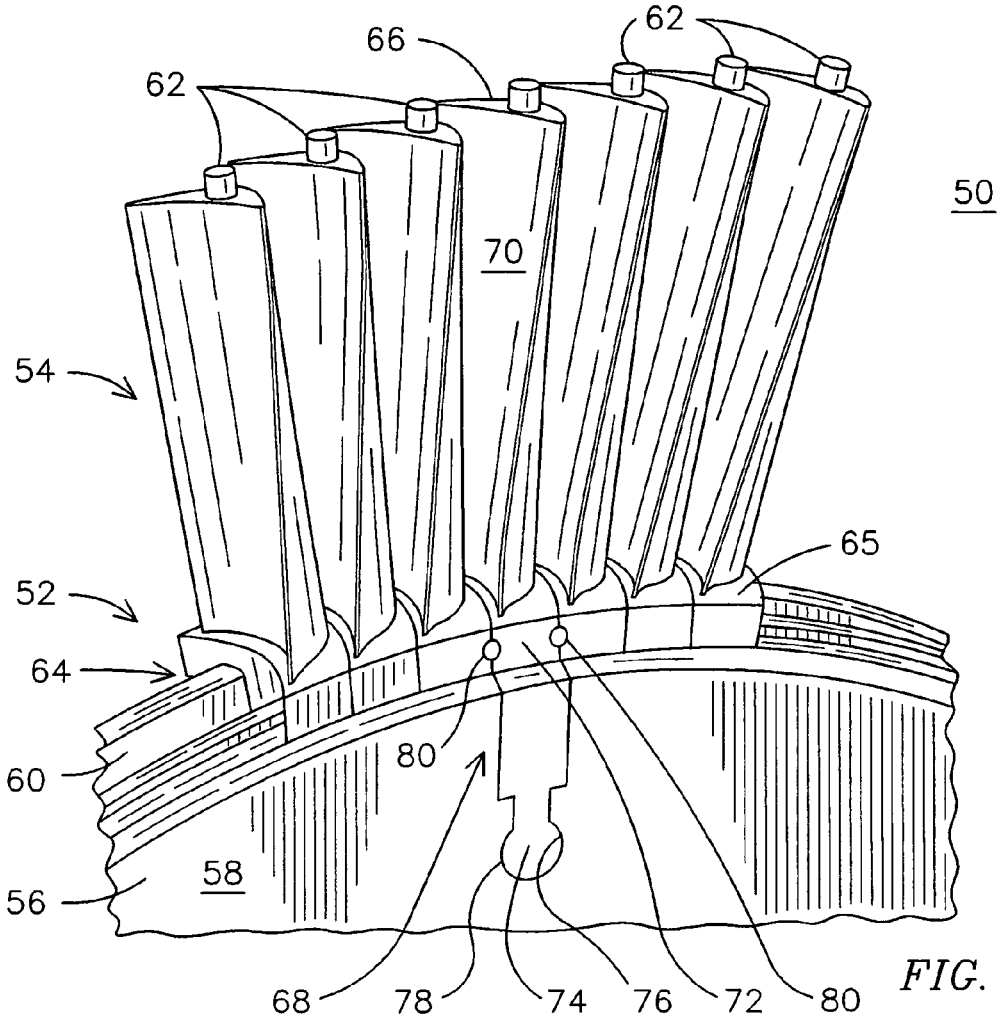
FIG. 8 is a partial perspective view of one embodiment of a radial entry turbine rotor disk utilizing an axial entry closing blade.

One embodiment of an improved blade locking arrangement for a radial entry turbine rotor disk is illustrated in FIG. 8. A turbo-machine 50 includes a rotating element 52, which in turn includes a row of blades 54 installed on a rotor disk 56. The rotor disk 56 is one of several disks joined to a shaft (not shown) for rotation within a casing (not shown) of the turbo-machine 50. The rotor disk 56 includes a disk shaped member 58 formed, such as by machining or grinding, to have a radial attachment shape 60 along its circumference. A plurality of radial entry blades 62 is installed on the rotor disk 56 at locations other than an entering slot location 68. Each of the plurality of blades 62 includes a radial attachment shape 64 that is complementary to and is engaged with the radial attachment shape 60 of the disk circumference. The term "radial attachment shape" is meant to include any profile used as a fastening mechanism for radial entry blades of turbo-machines. Radial attachment shapes generally resist radial movement of the blade while allowing circumferential movement along the disk perimeter at assembly once the complementary shapes of the blade and the disk are engaged after passing through an entering slot location on the disk perimeter. FIG. 8 is drawn to be representative of any known or possible radial attachment shape, such as a fir tree, reverse fir tree, T-shank, dog bone, etc.

The portions of rotating element 52 thus far described are no different than prior art designs, and they may be any known configuration or size made from any known material. Unlike prior art designs, the rotating element 52 of the embodiment of FIG. 8 includes a closing blade 66 at the entering slot location 68 that utilizes an axial blade attachment mechanism. Closing blade 66 includes an airfoil portion 70 and platform portion 72. Unlike the platform 65 of the radial entry blades 62, platform portion 72 of the closing blade 66 is a massive element that protrudes radially from the bottom of the airfoil portion 70 down to the bottom of the radial attachment shape 64 of the radial entry blades 62. Therefore, the platform portion 72 cooperates with the platforms 65 and radial attachment shapes 64 of the adjoining radial entry blades 62. Additionally, the configuration of the platform portion 72 and root portion 74 of the closing blade 66 is such that it completely repeats the configuration of the rotor disk 56 with a fully assembled row 54 of radial entry blades 62.

Closing blade 66 includes a root portion 74 that is formed to have an axial attachment shape 78 that is complementary to and engaged with a slot having an axial attachment shape 76 formed in the rotor disk 56 at the entering slot location 68. The slot 76 formed in the rotor disk 56 functions as both the radial blade entering location and as a fastening mechanism for the axially attached closing blade 66. The axial attachment shape 76 is formed radially inwardly from the circumferential radial attachment shape 60. The complementary axial attachment shapes 76, 78 are illustrated in FIG. 8 as a single dog bone shape; however, any shape allowing axial entry while resisting radial withdrawal may be used, such as a fir tree, T-shank, etc. Advantageously, the peak stress levels developed in the axial attachment mechanism of the closing blade 66 will be lower than peak stress levels developed in prior art closing blades that are secured with pins, and therefore, a full blade including airfoil portion 70 may be used for higher rotating speeds as well as the larger blade applications in a steam turbine. Thus, the present invention eliminates the need to use a closing piece 42 and corresponding filling piece 46 in most turbine blade rows, thereby eliminating the performance penalty and reducing stress levels when compared with prior art radial entry blade applications that utilize closing and filling pieces 42, 46.

Figure 9:
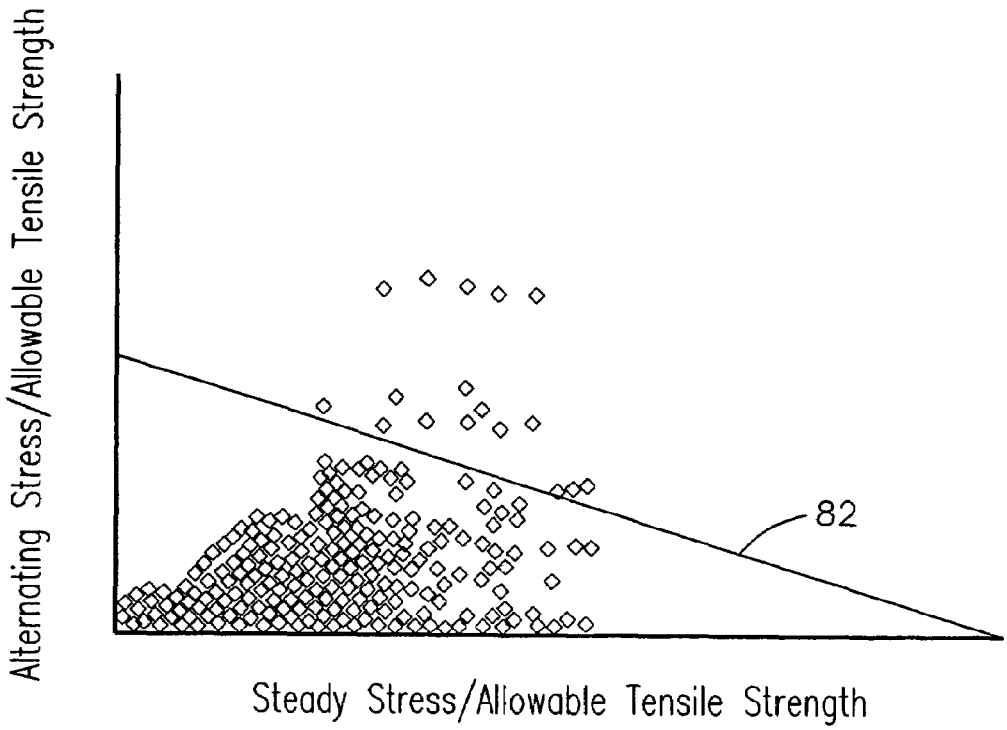
FIG. 9 PRIOR ART
FIG. 9 is a Goodman diagram for a row of radial entry blades in a prior art turbine.
Figure 10:
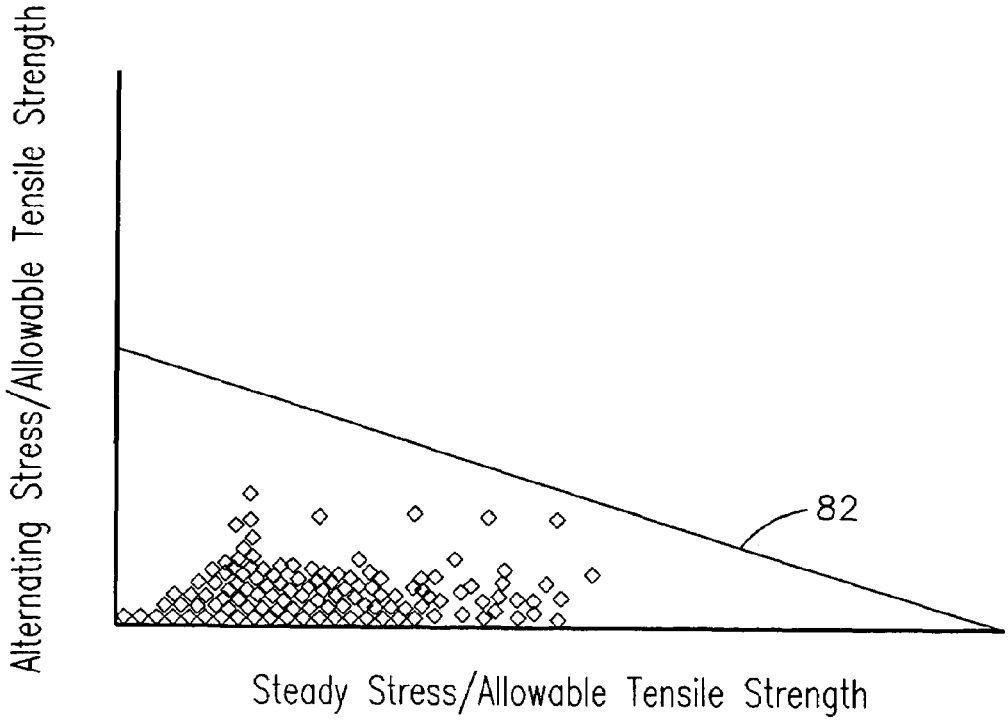
FIG. 10 is a Goodman diagram for the turbine of FIG. 9 as modified in accordance with the present invention.

FIGS. 9 and 10 illustrate one example of the reduction in stress levels that may be achieved with the current invention. FIG. 9 is a Goodman diagram for a row of radial entry blades for a prior art steam turbine which utilizes a closing piece and a filling piece in lieu of two of the blades in the row, and that incorporates two 180° blade groups. FIG. 10 is a Goodman diagram for the same row of blades operating at the same conditions after the turbine has been modified to incorporate a closing blade locking arrangement as described herein, thereby placing fully functioning blades in the locations of the closing and filling pieces and providing a full 360° blade group. A comparison of the two figures reveals that the modified design reduces stress levels overall, and maintains all stress levels to be below the maximum allowable level as indicated by line 82. These results are based upon calculations and are presented as being representative rather than for any specific application.

The fit of the closing blade 66 within the axial attachment slot 76 is loose enough, such as a gap of 0.001-0.002 inches, to facilitate the installation of the closing blade 66 after a complete complement of radial entry blades 62 are installed onto the rotor disk 56. Such a loose fit would not be appropriate for operation of the turbo-machine 50. Accordingly, at least one contact pin 80 is installed between the closing blade 66 and the adjacent radial entry blades 62. FIG. 8 illustrates two such contact pins 80 installed on opposed sides of the closing blade platform 72. Contact pins 80 may be made of a material exhibiting different material properties than the adjoining blades 62, 66; for example, with a higher coefficient of thermal expansion so that the joints between adjacent blades 62, 66 will tighten as the turbo-machine 50 heats up during operation. The contact pins may be of various shapes and may be shrunk-fit in place to facilitate joint tightness.

The geometry of the axial attachment shape 76 of entering slot location 68 may be selected to accommodate application-specific loads and materials. Portions of the mechanism that are subject to the highest loads are generally formed without sharp corners to avoid stress concentration concerns. Only one such slot 68 is needed per rotor disk 56 in order to allow for the installation of the radial entry blades 62, however more than one may be provided. For example, if a prior art radial entry disk is found to exhibit a crack or other flaw in its perimeter material, the flaw and surrounding material may be removed, such as by grinding or machining, to form an axial attachment shape 76. An axial entry closing blade 66 may then be installed at that location in lieu of a radial entry blade that previously occupied that space. In this manner, a disk flaw is repaired without the need for welding or other material addition process, thereby simplifying the repair process. In a similar process, a prior art radial entry disk assembly may be modified to incorporate an axial entry closing blade by changing the blade entering slot to take the form of an axial attachment shape. This may be desired simply to reduce a stress level in the row and/or to improve the efficiency of the unit by eliminating the use of a closing piece and filling piece for large blade applications. It is anticipated that efficiency gains of 5-10% may be achieved in most applications due to the addition of airfoils where closing and filling pieces were previously installed.

Figure 11:
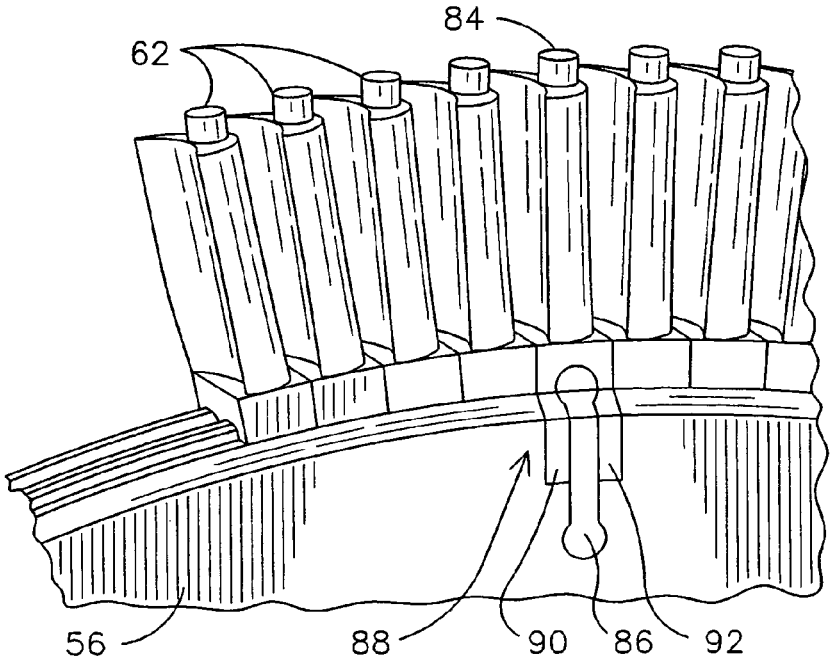
FIG. 11 is a partial perspective view of a second embodiment of a radial entry turbine rotor disk utilizing an axial entry closing blade.

FIG. 11 illustrates another embodiment where a closing blade 84 is secured to a rotor disk 56 by a key 86. The root portion 88 of closing blade 84 includes two opposed legs 90, 92. The key 86 is installed between the two legs 90, 92 to urge the root portion 88 into contact with the adjacent blades. The key 86 may be formed of a material that is different than the material of construction of the root portion 88, for example to provide a higher yield strength, fatigue limit, or coefficient of thermal expansion to provide increased contact force at operating temperatures. The key 86 may be shrink-fit into position and may eliminate the need to use a contact pin as was described for the embodiment of FIG. 8. The key and corresponding slots formed into the rotor disk 56 and root portion 88 may take any desired axial attachment shape, such as the double dog bone that is illustrated by way of example.

Figure 12:
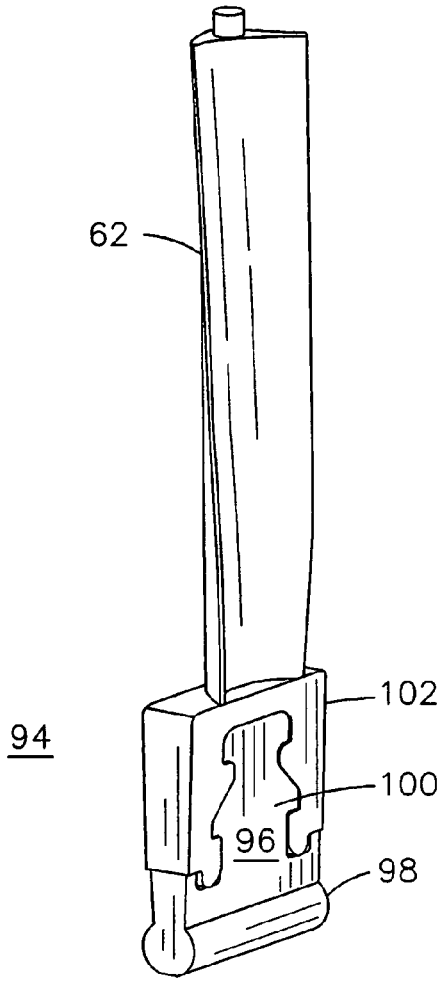
FIG. 12 is a perspective view of an axial entry closing blade incorporating a radial entry blade and an axial entry connecting member.

FIG. 12 illustrates another embodiment of a radial entry closing blade locking arrangement 94. This embodiment utilizes a radial entry blade 62 that is substantially identical to the other radial entry blades 62 installed around the perimeter of a radial entry turbine rotor disk. The term "substantially identical" is used to indicate that two parts are designed and manufactured to be interchangeable, and they are within normal manufacturing tolerances of being identical to each other. The blade locking arrangement 94 utilizes a connecting member 96 for securing the blade 62 onto the rotor disk. Connecting member 96 includes a radially inner portion 98 configured for axial insertion into an axially arranged slot formed in the rotor disk (not shown in FIG. 12, but may be similar to the axial attachment shapes of FIG. 8 or FIG. 11) and a radially outer portion 100 configured for engaging the root portion 102 of closing blade 62. The connecting member 96 may be fabricated of a material that is different than the material of the rotor disk or the blade 62 if desired, such as a higher yield strength or greater coefficient of thermal expansion for example. The locking arrangement 94 may be augmented by a closing pin (not shown) to ensure a tight fit with adjoining blades during operation of the turbo-machine.

Figure 13:
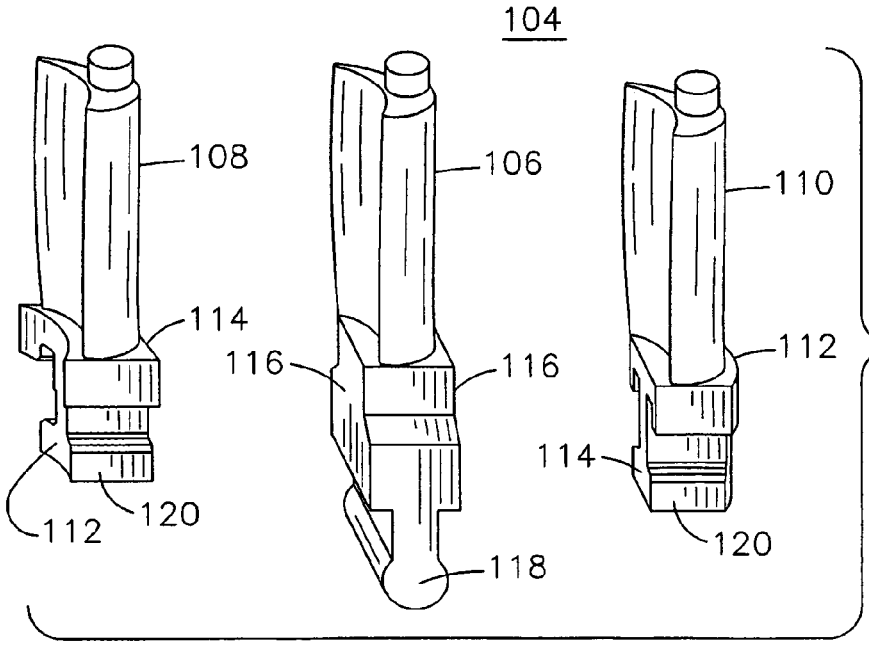
FIG. 13 contains a perspective view of an axial entry closing blade group for a radial entry rotor disk utilizing curved blade faces, the group containing a closing blade, an adjoining preceding blade and a following blade.

It is known that certain embodiments of radial entry blades utilize platforms and root portions having complementary abutting curved faces. One will appreciate that the arrangements illustrated in FIGS. 8 and 11 require the closing blade 66, 84 to be slid axially into position in a direction perpendicular to the rotor disk face (parallel to the rotor shaft) after the adjacent radial entry blades 62 have been installed into their respective operating positions. Such straight axial movement of the closing blade would not be possible with blades having curved faces. FIG. 13 illustrates an axial entry closing blade group 104 for a radial entry rotor disk (not shown) utilizing blades having curved root/platform faces. The group 104 contains a closing blade 106 and adjoining preceding blade 108 and following blade 110. The preceding blade 108 and the following blade 110 are each fabricated to have one curved root/platform face 112 and one opposed flat root/platform face 114. Curved root/platforms are for abutting the adjoining standard radial entry blades (not shown) while flat root/platform faces are for abutting the flat root/platform of closing blade 106. The preceding blade 108 and the following blade 110 each have a root portion 120 formed to the radial attachment shape of the other radial entry blades in the row, such as an internal fir tree, an external fir tree or the T-shank shape illustrated, for example. The closing blade 106 is formed to have two opposed flat platform faces 116 that extend radially inwardly to abut the respective flat root/platform faces 114 of the preceding blade 108 and following blade 110. Radially inward from the flat platform faces 116, the closing blade 106 has a root portion 118 formed to have an axial attachment shape. The preceding blade 108 and following blade 110 are installed onto a radial entry disk so that they are positioned adjacent to and on opposed sides of the entering slot location so as to expose their respective flat faces 114 to the entering slot location. This allows the closing blade 106 to be installed by sliding its root portion 118 into a mating axial attachment slot shape (not shown) formed at the entering slot location. The root portion 118 and mating slot formed in the disk may be any desired shape, such as a fir tree or the illustrated dog bone shape, for example. Contact pins (not shown) may be used to ensure a tight fit between the blades of the row. Except for the flat faces 114, preceding blade 108 and following blade 110 may be fabricated to be substantially identical to the adjoining radial entry blades.

Figure 14:
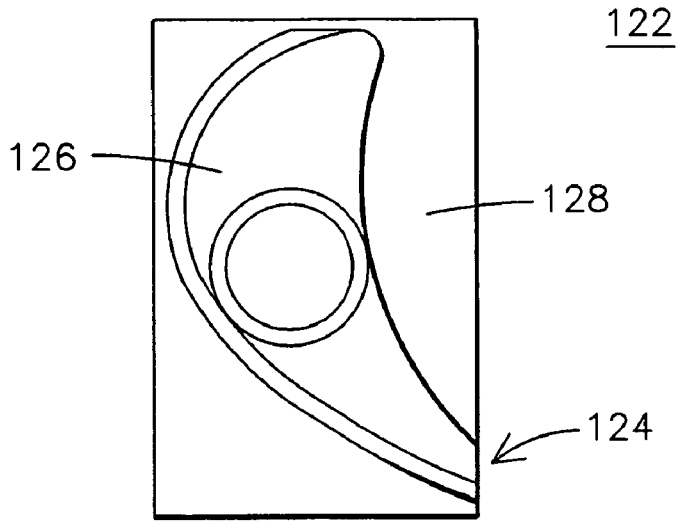
FIG. 14 is a top view of a closing blade having a flat-faced platform with the insertion axis perpendicular to the rotor disk face.
Figure 15:
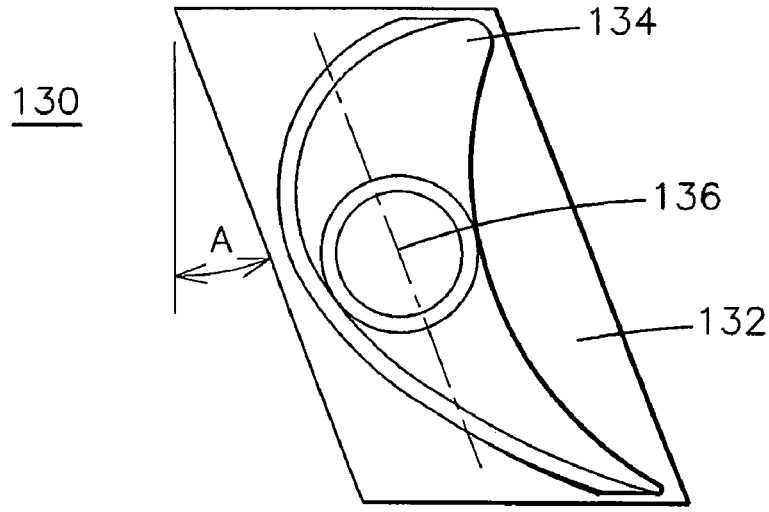
FIG. 15 is a top view of a closing blade having a non-rectangular parallelogram platform with the insertion axis transverse to the rotor disk face.

One may appreciate that in certain embodiments the entire curved airfoil section of closing blade 106 may not fit within the footprint of the flat-faced platform, as viewed from above the airfoil along a radial axis of the rotor disk. FIG. 14 is a top view of one such closing blade 122 wherein a trailing edge portion 124 of the airfoil 126 is missing because it otherwise would have extended beyond the footprint of the platform 128. This geometry is less than optimal due to a degraded aerodynamic performance of the airfoil 126 when compared to a full airfoil. One technique for avoiding this situation is illustrated by closing blade 130 of FIG. 15 where the platform 132 is a non-rectangular parallelogram angled to provide a footprint sufficient to support the entire airfoil 134. In this embodiment, the axial attachment shape of the root is formed to have an insertion axis (136) that is complementary to the shape of the parallelogram and is transverse to the rotor disk face by an angle A, such as approximately 10-20° for example. The adjoining preceding and following blades would be formed to have their respective flat root faces disposed at the same angle A so that the closing blade can be inserted into the blade row in the direction of the insertion axis 136 that is transverse to the rotor disk face by the angle A.

A method of securing a row of radial entry blades 62 onto a turbine rotor disk 56 is disclosed herein. A radial attachment shape 64 is formed along a circumference of the rotor disk by known techniques. An entering slot location 68 is also formed on the circumference of the rotor disk, with the entering slot location including an axial attachment shape 76. Radial entry blades 62 are then installed onto the rotor disk through the entering slot location 68 so that the radial attachment shapes of their respective roots are engaged with the radial attachment shape formed on the rotor disk. A closing blade 66 is then installed at the entering slot location to complete the row of blades, with an axial attachment shape 78 of the root portion 74 of the closing blade being engaged with the axial attachment shape 76 formed on the rotor disk and the root portion 74 (i.e. closing blade platform) is engaged with the adjacent blades. One or more contact pins 80 may be used to ensure a tight fit between adjoining blades. One or more such axial entry blades may be utilized in the row. A closing blade 84 having a root portion 88 having two spaced-apart legs may be installed with a key 86 inserted between the two legs for urging the root portion 88 into contact with the adjacent blades. Optionally a closing blade 62 substantially identical to the other radial entry blades 62 may be used. Such a closing blade 62 is first attached to a connecting member 96 by engaging complementary radial attachment portions, and then the assembly is engaged with the rotor disk via complementary axial attachment portions.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A rotating element for a turbo-machine comprising:
- a rotor disk;
- a first radial attachment shape formed along a circumference of the disk;
- a first axial attachment shape formed in the circumference of the rotor disk at an entering slot location;
- a plurality of radial entry blades each comprising a root portion comprising a second radial attachment shape complementary to and engaged with the first radial attachment shape, the plurality of radial entry blades disposed along the circumference of the rotor disk at locations other than the entering slot location; and
- a closing blade disposed at the entering slot location and comprising a root portion comprising a second axial attachment shape complementary to and engaged with the first axial attachment shape.

2. The rotating element of claim 1, further comprising a contact pin disposed between the closing blade and an adjoining one of the plurality of radial entry blades.

3. The rotating element of claim 2, wherein the contact pin comprises a material exhibiting a coefficient of thermal expansion that is greater than respective coefficients of thermal expansion of materials of the closing blade and adjoining radial entry blade.

4. The rotating element of claim 1, further comprising:
- a root portion of the closing blade comprising a first leg and a second leg;
- a key disposed between the first and second legs for urging the root portion into contact with the disk.

5. The rotating element of claim 4, wherein the key comprises a double dog bone shape.

6. The rotating element of claim 4, wherein the key comprises a material different from a material of the root portion.

7. The rotating element of claim 4, wherein the material of the key exhibits higher yield strength than the material of the root portion.

8. The rotating element of claim 4, wherein the material of the key exhibits a coefficient of thermal expansion higher than the material of the root portion.

9. The rotating element of claim 4, wherein the material of the connecting member portion exhibits a coefficient of thermal expansion greater than the material of the radial entry blade portion.

10. The rotating element of claim 1, wherein the closing blade further comprises:
- a radial entry blade portion substantially identical to respective ones of the plurality of radial entry blades and comprising a root portion comprising the second radial attachment shape; and
- a connecting member portion comprising a radial attachment portion comprising the first radial attachment shape for engagement with the root portion of the radial entry blade portion, and an axial attachment portion comprising the second axial attachment shape engaged with the first axial attachment shape formed in the disk at the entering slot location.

11. The rotating element of claim 10, further comprising a contact pin disposed between the radial entry blade portion of the closing blade and an adjoining one of the plurality of radial entry blades.

12. The rotating element of claim 10, wherein the connecting member portion comprises a material different from a material of the radial entry blade portion.

13. The rotating element of claim 12, wherein the material of the connecting member portion exhibits a higher yield strength than the material of the radial entry blade portion.

14. The rotating element of claim 1, further comprising:
- each of the plurality of radial entry blades comprising a complementary pair of opposed curved faces;
- the closing blade comprising a pair of opposed flat faces;
- a preceding blade disposed adjacent a first side of the closing blade, the preceding blade comprising a root portion comprising the second radial attachment shape engaged with the first radial attachment shape, a curved face abutting an adjacent one of the plurality of radial entry blades, and a flat face abutting a first of the opposed flat faces of the closing blade; and a following blade disposed adjacent a second side of the closing blade opposed the preceding blade, the following blade comprising a root portion comprising the second radial attachment shape engaged with the first radial attachment shape, a curved face abutting an adjacent one of the plurality of radial entry blades, and a flat face abutting a second of the opposed flat faces of the closing blade.

15. The rotating element of claim 14, further comprising a contact pin disposed between the closing blade and one of the preceding blade and the following blade.

16. The rotating element of claim 1, further comprising:

the first and second radial attachment shapes each comprising one of a fir tree shape, a tee shank shape and a dog bone shape; and the first and second axial attachment shapes each comprising one of a fir tree shape, a tee shank shape and a dog bone shape.

17. The rotating element of claim 1, wherein the closing blade root portion comprises an insertion axis parallel to an axis of a rotor associated with the rotor disk.

18. The rotating element of claim 1, wherein the closing blade root portion comprises an insertion axis transverse to an axis of a rotor associated with the rotor disk.

19. A turbo-machine comprising the rotating element of claim 1.

20. The rotating element of claim 1, further comprising:

an axially arranged slot formed in the disk at the entering slot location; and a key comprising a radially inner portion configured for axial insertion into the axially arranged slot and a radially outer portion configured for engaging a root portion of the closing blade.

21. The locking arrangement of claim 20, wherein the key comprises a material different from a material of the rotor disk.

22. The locking arrangement of claim 20, wherein the key comprises a material different from a material of the root portion of the closing blade.

23. A turbo-machine comprising the rotating element of claim 20.

24. A rotating element for a turbo-machine comprising:

a generally disk shaped member comprising a circumference;

a radial attachment shape formed along the circumference for locating a plurality of radial entry blades in a row; and an axial slot formed at a radial blade entry location of the circumference and comprising an axial attachment shape for receiving a closing blade and for securing the closing blade during operation of the turbo-machine;

wherein the axial attachment shape comprises a dog bone shape.

25. The rotating element of claim 24, wherein the radial attachment shape comprises one of an internal fir tree, an external fir tree and a T-shank shapes.

26. The rotating element of claim 24, wherein the axial slot is disposed along an insertion axis parallel to a rotating axis of the rotating element.

27. The rotating element of claim 24, wherein the axial slot is disposed along an insertion axis transverse to a rotating axis of the rotating element.

28. A turbo-machine comprising the rotating element of claim 24.

29. A closing blade group for a row of radial entry turbine blades having curved root/platform faces, the group comprising:

a closing blade comprising an airfoil portion, a platform portion comprising a pair of opposed flat faces, and a root portion comprising an axial attachment shape complementary to an axial attachment shape formed in a rotor at an entering slot location;

a preceding blade comprising an airfoil portion, a platform portion comprising a curved face for abutting an adjacent radial entry blade and an opposed flat face for abutting a first of the flat faces of the closing blade, and a root portion comprising a first radial attachment shape complementary to a second radial attachment shape formed about a circumference of the rotor; and a following blade comprising an airfoil portion, a platform portion comprising a flat face for abutting a second of the flat faces of the closing blade and an opposed curved face for abutting an adjacent radial entry blade, and a root portion comprising the first radial attachment shape.

30. The group of claim 29, wherein the pair of opposed flat faces of the closing blade are disposed parallel to a rotational axis of the rotor.

31. The group of claim 29, wherein the pair of opposed flat faces of the closing blade are disposed transverse to a rotational axis of the rotor and parallel to an insertion axis of the axial attachment shape of the closing blade.

32. The group of claim 29, wherein the radial attachment shape comprises one of an internal fir tree, an external fir tree and a T-shank shapes.

33. The group of claim 29, wherein the axial attachment shape comprises a dog bone shape.

34. A turbo-machine comprising the closing blade group of claim 29.

35. A method of securing a row of radial entry blades onto a turbine rotor disk, the method comprising:

forming a first radial attachment shape along a circumference of the rotor disk;

forming an entering slot location on the circumference of the rotor disk;

forming a first axial attachment shape at the entering slot location;

installing onto the circumference of the rotor disk via the entering slot location a plurality of radial entry blades comprising a second radial attachment shape complementary to and engaged with the first radial attachment shape; and installing at the entering slot location an axial entry closing blade comprising a second axial attachment shape complementary to and engaged with the first axial attachment shape.

36. The method of claim 35, further comprising installing a contact pin between the closing blade and an adjacent radial entry blade.

37. The method of claim 35, further comprising forming the closing blade to comprise a root portion comprising two legs and an axial key portion disposed between the two legs and extending to form the second axial attachment shape.

38. The method of claim 35, further comprising forming the axial key portion of a material different from a material of the platform portion.

39. The method of claim 35, further comprising forming the closing blade to comprise a radial entry blade portion substantially identical to ones of the plurality of radial entry blades and a connecting member portion comprising a radial attachment portion comprising the first radial attachment shape for engagement with the radial entry blade portion and an axial attachment portion comprising the second axial attachment shape.

40. The method of claim 35, further comprising forming the first and second axial attachment shapes to have an insertion axis parallel to a rotational axis of the disk.

41. The method of claim 35, further comprising forming the first and second axial attachment shapes to have an insertion axis transverse to a rotational axis of the disk.

42. A method of modifying a radial entry turbo-machine rotor disk as applied to a rotor disk supporting blades having curved platform faces, the method comprising:

removing material containing a flaw from a periphery portion of a radial entry rotor disk to form an axial attachment shape;

installing an axial entry blade onto the radial entry rotor disk in engagement with the axial attachment shape;

providing the axial entry blade to have two opposed flat platform faces;

installing a radial entry protecting blade and a radial entry following blade adjacent the axial entry blade, each of the preceding blade and the following blade comprising a flat platform face for abutting a respective one of the two axial entry blade flat platform faces, and each of the preceding blade and the following blade comprising an opposed curved platform face for abutting an adjacent radial entry blade.

43. The method of claim 42, further comprising installing a contact pin between the axial entry blade and at least one adjacent radial entry blade installed on the rotor disk.

44. The method of claim 42, further comprising forming the flat platform faces of the preceding blade, the following blade and the closing blade to be parallel to an axis of rotation of the disk.

45. The method of claim 42, further comprising forming the flat platform faces of the preceding blade, the following blade and the closing blade to be transverse to an axis of rotation of the disk.

* * * * *